United States Patent [19]

Radek et al.

[11] Patent Number: 4,718,578

[45] Date of Patent: Jan. 12, 1988

[54] BULK GOODS DISPENSER

[75] Inventors: John R. Radek, Hinsdale; Al Kaminecki, Chicago; Len Laskowski, Woodridge, all of Ill.

[73] Assignee: Ready Metal Manufacturing Company, Chicago, Ill.

[21] Appl. No.: 795,896

[22] Filed: Nov. 7, 1985

[51] Int. Cl.[4] ..... B67D 5/60

[52] U.S. Cl. ..... 222/108; 141/317; 220/324; 222/154; 222/185; 222/357; 222/517

[58] Field of Search ..... 222/108, 185, 153, 158, 222/356-359, 404, 405, 409, 322, 243, 245, 368, 369, 393, 387, 448, 457, 372, 336, 339, 559, 129, 135, 181; 221/262, 154; 414/3, 8; 141/98, 108, 313, 314, 317, 391; 220/324; 211/126, 128, 133

[56] References Cited

U.S. PATENT DOCUMENTS

| | | | |
|---|---|---|---|
| 472,020 | 4/1892 | Acker | 222/405 X |
| 537,615 | 4/1895 | Novotny | 141/317 X |
| 669,075 | 3/1901 | Claggett | 222/245 |
| 697,148 | 4/1902 | Jeffreys | 221/262 X |
| 822,638 | 6/1906 | Vester | 222/190 |
| 1,218,092 | 3/1917 | Larsen | 222/356 |
| 1,317,594 | 9/1919 | Ryan | 222/357 |
| 1,728,939 | 9/1929 | Konipol | 222/357 |
| 1,751,169 | 3/1930 | Parker | 221/154 X |
| 2,036,549 | 7/1935 | Smith | 222/322 |
| 2,119,224 | 8/1937 | Dahlin | 222/358 X |
| 2,830,744 | 4/1958 | Polsen et al. | 222/357 |
| 3,252,614 | 5/1966 | Evans | 211/126 X |
| 3,464,579 | 9/1969 | Asenbauer | 220/324 X |
| 3,524,212 | 8/1970 | Spencer | 200/324 X |
| 3,628,793 | 12/1971 | Mudloff | 220/324 X |
| 4,006,850 | 2/1977 | Farina | 222/356 |
| 4,211,343 | 7/1980 | Hughes et al. | 222/564 X |
| 4,311,257 | 1/1982 | Grieco et al. | 222/494 X |
| 4,319,700 | 3/1982 | Celender et al. | 222/559 X |
| 4,349,128 | 9/1982 | Sanfilippo | 222/547 X |
| 4,440,322 | 4/1984 | Henry | 222/153 |
| 4,562,941 | 1/1986 | Sanfilippo | 222/181 X |
| 4,589,576 | 5/1986 | Knight et al. | 222/357 |
| 4,590,974 | 5/1986 | Mathews | 222/108 X |
| 4,650,098 | 3/1987 | Ellis et al. | 222/357 X |

FOREIGN PATENT DOCUMENTS

| | | | |
|---|---|---|---|
| 656536 | 5/1929 | France | 222/322 |
| 223365 | 10/1924 | United Kingdom | 222/357 |

*Primary Examiner*—F. J. Bartuska
*Assistant Examiner*—Kevin P. Shaver
*Attorney, Agent, or Firm*—Balogh, Osann, Kramer, Dvorak, Genova & Traub

[57] ABSTRACT

A bulk goods dispenser having a bin for holding the bulk goods which can be removed by a manipulator mounted in a dispensing unit communicating with the interior of the bin, the removed bulk goods being temporarily collected in a chute prior to being dispensed by a trap door into a bag which is attachable to walls of the chute, the walls being provided with holding horns. The trap door is held in a closed position by a spring member until released by a handle. The manipulator has a scoop for moving the bulk goods over a slanting wall in the bin. The bin has a slidable cover which can be locked. The dispenser unit can also be locked to the bin. A false bottom can vary the holding capacity of the bin.

3 Claims, 4 Drawing Figures

FIG. 1
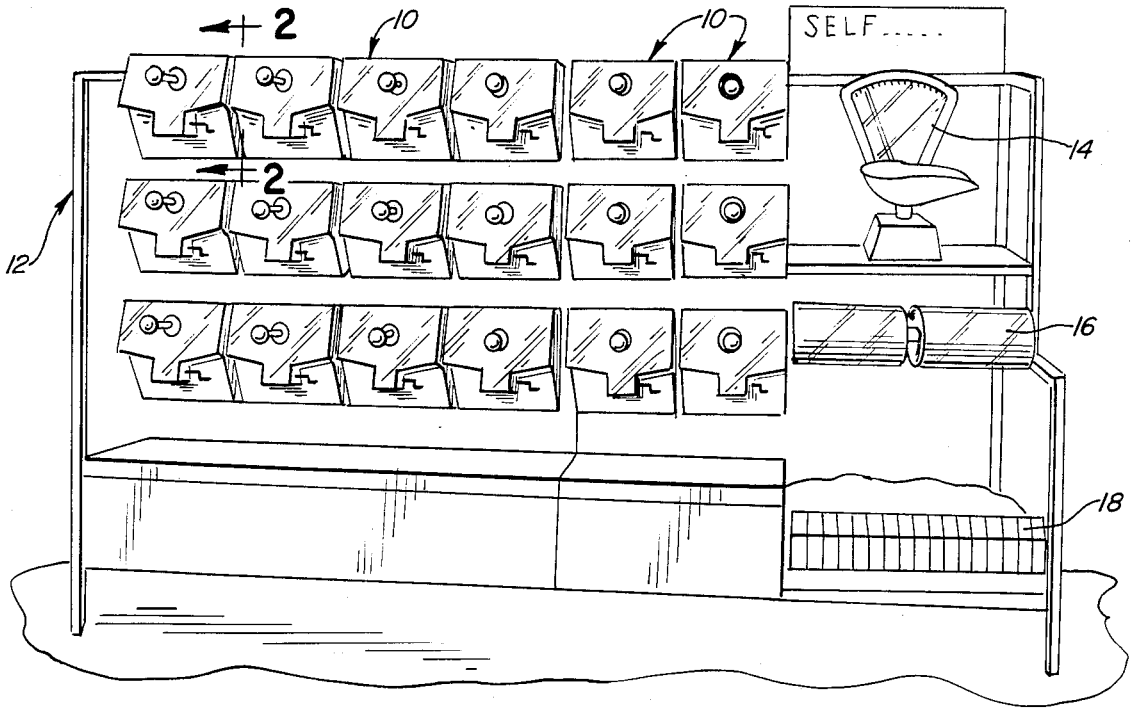
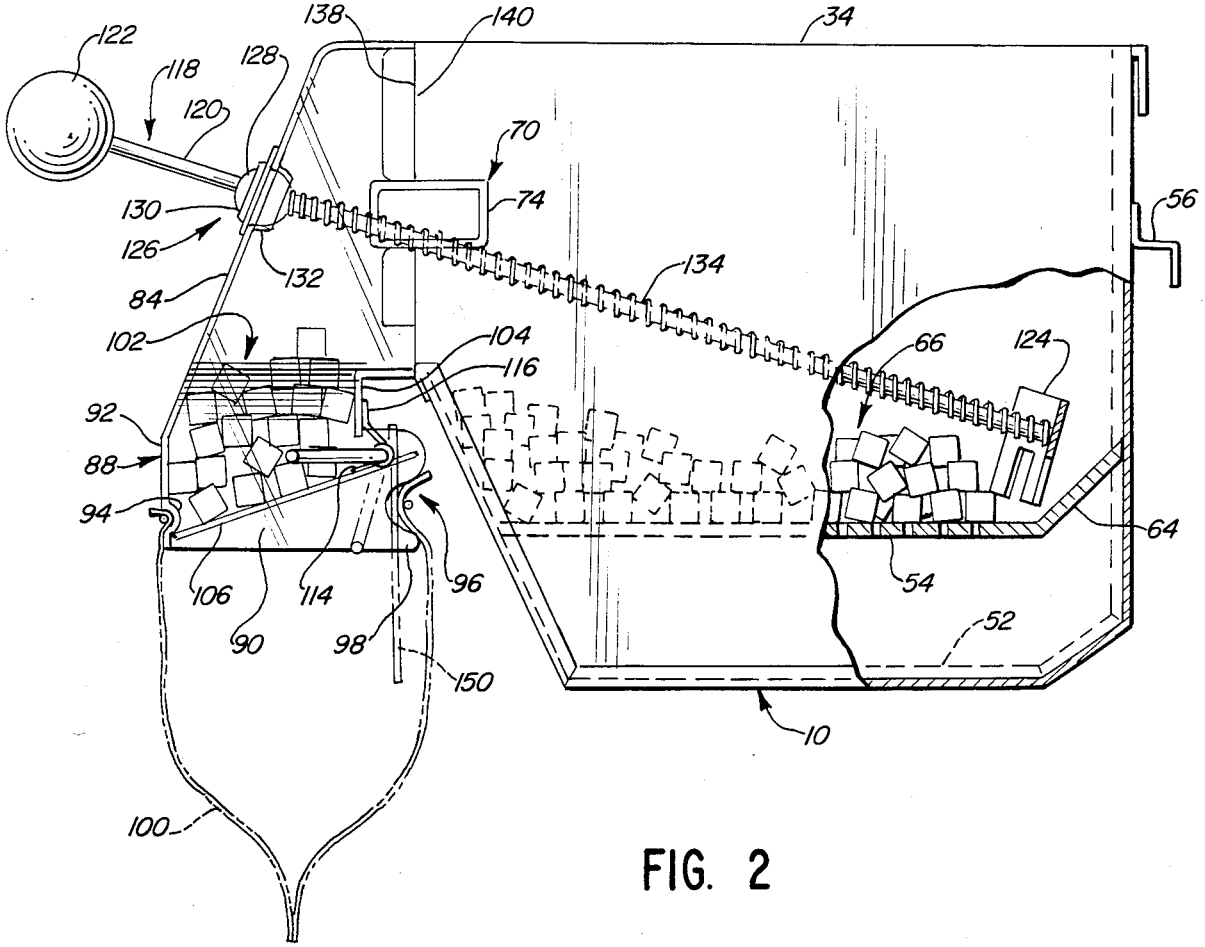
FIG. 2

BULK GOODS DISPENSER

BACKGROUND OF THE INVENTION

1. Field of the Invention

This invention relates generally to a dispensing device, and more particularly for dispensing bulk goods from storage containers.

2. Description of the Prior Art

Although most particulate foods such as candy, beans, rice, etc., are available in packaged containers in retail stores, there is a trend toward dispensing such foods from bulk containers, usually in stores stressing self service by customers. Generally, such bulk foods are kept in containers from which they can be reomved by a customer by using a scoop to fill a predetermined amount into a bag which is then weighed. Such containers containing the bulk foods are generally open or covered. However, the complete interior of the containers is totally exposed to the public. To limit the amount of exposure of the bulk goods, it is preferable to use dispensers which deny access to the interior of the dispenser except through an intermediary of a mechanical arrangement for scooping out the desired amount of the bulk goods into a bag or container.

A number of dispensers have been developed for dispensing various particulate foods. For example, U.S. Pat. No. 669,075 describes a vending tray for dispensing heated peanuts. However, the dispensing arrangement is incomplete in that it requires a sales clerk to use an additional scoop to place the peanuts in a bag. In another form a dispenser, U.S. Pat. No. 2,119,224 describes an arrangement for dispensing cherries, one at a time, as required in the prparation of a cocktail. This type of a dispenser would not be proper for dispensing particulate food. None of the foregoing dispensing arrangements are adaptable for use in a store in which customers help themselves to different particulate foods.

SUMMARY OF THE INVENTION

It is the object of the invention to provide a bulk goods dispenser having an interior chamber filled with particulate goods which are visible through transparent walls of the dispenser, the dispenser being provided with mechanical means for removing a predetermined portion of the goods into a chute area which can be opened to permit the garnered goods to fall into a bag secured below the chute.

It is an object of the invention to provide a bulk goods dispenser that can be adjusted to obtain one or more sized chambers for displaying various quantities of the bulk goods. This is provided by means of a false bottom that can be elevated to desired heights to achieve different capacities of a storage bin.

It is a further object of the invention to provide a dispenser with a mechanical means for scooping out a predetermined amount of bulk goods into an intermediate area so that, after a predetermined amount of bulk goods has been scooped up, the scooped bulk goods are then released through a trap door into a bag or container for weighing.

It is a further object of the invention to present a novel housing for the dispenser that can be easiy taken apart for cleaning and which can be set up to be locked so that access into the interior of the dispenser cannot be obtained by the general public.

BRIEF DESCRIPTION OF THE DRAWINGS

The invention will now be described in reference to the following drawings, wherein:

FIG. 1 shows a plurality of bulk goods dispensers arranged on a rack provided with a scale and rolls of dispensable plastic bags;

FIG. 2 is an enlarged sectional side view of the dispenser;

DESCRIPTION OF THE PREFERRED EMBODIMENT

Figure 3:
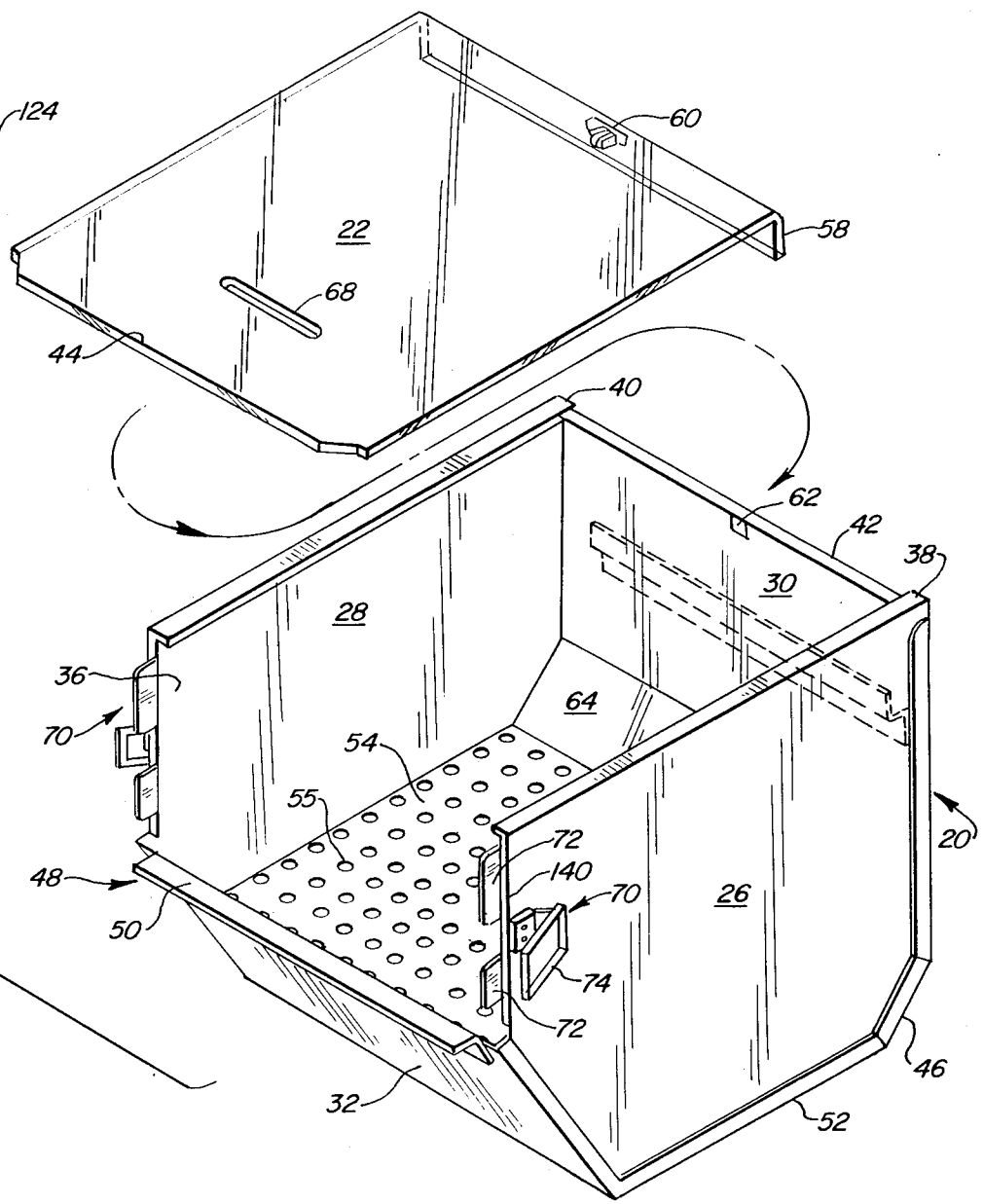
FIG. 3 is an exploded view showing the various components comprising the dispenser.
Figure 3:
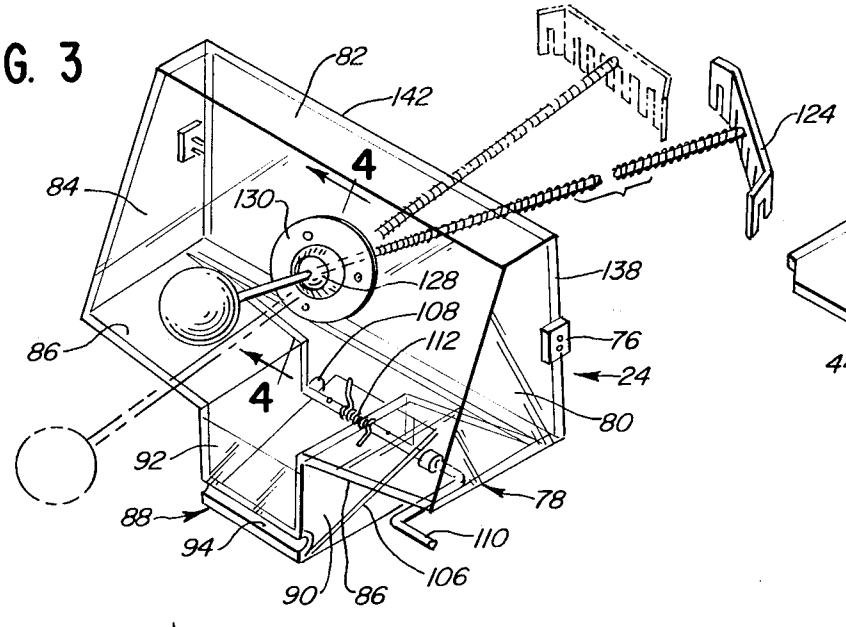

Referring to FIG. 1, there is shown a plurality of dispensers 10 arranged in columns and rows on a rack 12, which also supports a weighing scale 14, rolls of plastic bags 16, and a trash disposal bin 18.

As particularly shown in FIG. 3, the dispenser 10 comprises a bin 20, a top cover 22 for the bin, and a dispensing unit 24.

The bin 20 has a pair of side walls 26, 28, a back wall 30, a slant wall 32, and the top cover 22. An opening 36 defined by the top cover 22, the spaced side walls 26 and 28, and the slant wall 32, is adapted to receive the dispensing unit 24.

The spaced walls 26 and 28 are provided with slide flanges 38 and 40 which define a sliding path for the top cover 22 as it is inserted between the slide flanges 38 and 40 and over a top 42 of the back wall 30. When the top cover 22 is in a position covering the bin 20, a front edge 44 of the top cover is chamfered and is adapted to engage in a groove in the dispenser unit 24, as will be described later.

As shown in FIG. 3, the walls of the bin are secured together by a frame work 46. Alternatively, the walls of the bin can be secured together by cementing. The upper portion of the slant wall 32 is provided with a bracket 48 which has a lip 50 for supporting the bottom of the dispensing unit 24 when the dispenser 10 is fully assembled. The bin 20 has a bottom 52 and an adjustable false bottom 54 which can be adjusted vertically above the bottom 52 by any appropriate means to thereby provide different capacities for holding the bulk goods. The false bottom 54 is provided with a plurality of apertures 55 which permit broken particles of the comminutated goods 66 to fall through and collect on the bottom 52. The back wall 30 is provided with a hanging bracket 56 which is adapted to engage a horizontal bar (not shown) on the rack 12. The top cover 22 is provided with a flange 58 provided with a lock member 60 which cooperates with an apeture 62 in the back wall 30 for securing the top cover 34 to the bin 20. The false bottom 54 is provided with a slanting portion 64 which urges forwardly the bulk goods 66 toward the slant wall 32. The top cover 22 is provided with a finger hold 68 which facilitates the movement of the top cover in forward or rearward directions. The upper portions of the side walls 26 and 28 are provided with clamping members 70, each clamping member having a pair of slides 72 abutting the inside surfaces of the side walls, a clasp member 74 and an anchor member 76 which is secured to the dispensing unit 24. To attach the dispensing unit 24 to the bin 20, the clasp member 74 is moved forwardly to engage the anchor member 76 and is then moved backwardly to complete the securement.

The dispensing unit 24 comprises an integrally molded housing 78 having a pair of side walls 80, a top wall 82, a slant wall 84, and a pair of bottom walls 86 which are spaced from each other and inbetween define a chute 33 which has a pair of spaced side walls 90 and a front wall 92.

As best viewed in FIG. 2, the lower portion of the front wall 92 of the chute 88 is provided with a semi-circular indentation 94, and the side walls 90 of the chute 88 are provided with semi-circular indentations 96 which define a pair of horns 98 which, in conjunction with the semi-circular indentation 94, cooperate to define a support over which a bag 100 may be draped for the purpose of receiving a quantity of bulk goods accumulated in the chute 88. Between the side walls 90, the front wall 92, and a back wall 104, a trap door 106 is swingably supported in the chute 88.

As best seen in FIG. 3, the trap door 106 is movably supported on a shaft 108 passing through apertures in the side walls 90. One end of the shaft 108 terminates in a handle 110 which can be manipulated to depress the trap door 106 to permit the accumulated bulk goods 102 to fall into the bag 100. To maintain the trap door 106 in a closed position, a spring 112 is coiled around a portion of the shaft 108 and has one end 114 abutting the trap door 106 and another end 116 abutting the outside surface of the back wall 104. When the handle 110 is pivoted counterclockwise, the trap door 106 moves in a downward direction to assume the phantom position 150 shown in FIG. 2, whereupon the bulk goods 102 in the chute 88 will fall into the bag 100.

The dispensing unit 24 is provided with a manipulator 118 which comprises a rod 120 having one end thereof terminating in a ball 122, and the other end terminating in a scoop 124. The rod 120 passes through a ball joint 126 supported by the slant wall 84. The ball joint 126 has a ball 128 supported in the slant wall 84 by a ring plate 130 and a partially spherical indentation 132 in the slant wall 84 to accommodate the spherical contour of the ball 128. The plate 130 is appropriately secured by a member such as a rivet 133 to the slant wall 84.

Figure 4:
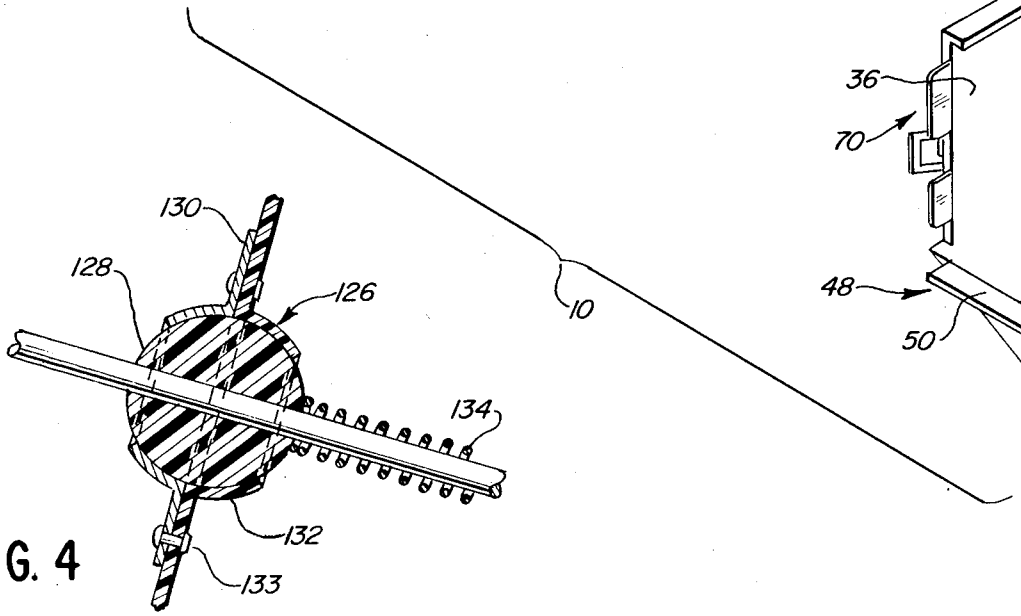
FIG. 4 is an enlarged sectional view taken along lines 4—4 of FIG. 3.

In order to maintain the scoop 124 in its most inward position, a helical spring 134 extends, under compression, between the scoop 124 and the ball 128. The ball joint 126 is best viewed in the enlarged partial sectional view shown in FIG. 4.

Preferably, the structural wall components of the dispenser 10 are made from a clear plastic material to provide maximum visibility.

After the bin 20 is filled with bulk goods, the dispensing unit 24 is fitted to the bin 20 by placing the bottom walls 86 of the housing 78 on top of the lip 50, and then the housing 78 is centered with respect to the bin 20 so that edges 138 of the side walls 80 engage the slides 72 and abut the edges 140 of the side walls 26 and 28 of the bin 20. Thereafter, the clasp members 74 are fitted over the anchor members 76, and the clasp members 74 are then forced toward the back wall 30 to complete the clamping securement. The top wall 82 of the housing 78 has an edge 142 which abuts the edge 44 of the top cover 34.

The clamping member 70 may be of the type requiring a special tool for opening so that unauthorized access is denied to the public.

As can be readily seen, the dispenser 10 can be removed from its mounted position on the rack 12 and then disassembled by removing the dispensing unit 24 from the bin 20. Thereafter, the top cover 34 and the false bottom 54 can be removed, and all of the components can be easily cleaned.

Since the rod 120 is threadedly connected to the ball 122 and the scoop 124, the manipulator 118 can be taken apart for cleaning purposes. Furthermore, a different type of a scoop can be attached to the rod 120, as may be required, for functioning properly in scooping bulk goods or materials having different physical properties.

Although the dispenser has been described with particularity as to detail, it is not the intention to limit the construction to the particular form described and shown herein, since modifications may be made therein without departing from the spirit of the invention.

What is claimed is:

1. A dispenser for dispensing particulate goods directly into a receptacle, comprising a bin for receiving and storing said particulate goods, said bin having walls defining a goods receiving opening, one of said walls slanting upwardly from the bottom of said bin toward said opening and defining a ledge, a dispenser unit supported on said ledge in abutting relationship closing off said receiving opening, means for detachably securing said dispenser unit to said bin, said dispenser unit having a housing formed by walls including a transparent front slanted wall and a pair of spaced bottom walls defining with a portion of said front wall a downwardly extending chute having a retractable trap door resiliently biased into a closed position by a spring, a handle secured to said trap door and passing through spaced walls of said housing for pivotally mounting said trap door on said housing, and a manipulator extending through said front wall and retractably mounted for scooping a portion of said particulate goods of said bin into said chute.

2. A dispenser according to claim 1, including a false bottom provided with apertures and supporting said particulate goods, said apertures sifting minute broken particles in the goods.

3. A dispenser according to claim 1, wherein said front slanted wall facilitates the movement of said particulate goods withdrawn by said manipulator into said chute.

* * * * *